US005577336A

United States Patent [19]

Jensen

[11] Patent Number: 5,577,336

[45] Date of Patent: Nov. 26, 1996

[54] DISPLAY WITH REARRANGEABLE CHARACTERS

[76] Inventor: Palle L. Jensen, Backersvej 142, DK-2300 Copenhagen S., Denmark

[21] Appl. No.: 305,022

[22] Filed: Sep. 13, 1994

Related U.S. Application Data

[63] Continuation of Ser. No. 7,517, Jan. 22, 1993, abandoned.

[51] Int. Cl.[6] ..... G09F 3/04

[52] U.S. Cl. ..... 40/450; 40/492; 116/306

[58] Field of Search ..... 40/450, 451, 492, 40/503, 504, 506, 377; 116/306

[56] References Cited

U.S. PATENT DOCUMENTS

| | | | |
|---|---|---|---|
| 3,740,878 | 6/1973 | Oelschlaeger . | |
| 4,063,377 | 12/1977 | Hukill | 40/492 X |
| 4,164,824 | 8/1979 | Nidelkoff | 40/450 |
| 4,411,084 | 10/1983 | Kraus . | |
| 4,542,603 | 9/1985 | Streeter et al. | 40/447 |
| 4,597,209 | 7/1986 | Hukill | 40/486 X |
| 5,080,516 | 1/1992 | Ward | 40/503 X |
| 5,315,775 | 5/1994 | Parker et al. | 40/450 |
| 5,388,356 | 2/1995 | Kalivas | 40/450 |

FOREIGN PATENT DOCUMENTS

| | | | |
|---|---|---|---|
| 35671/84 | 1/1985 | Australia . | |
| 5397/87 | 10/1987 | Denmark . | |
| 31033 | 7/1981 | European Pat. Off. | 40/450 |
| 482885A1 | 4/1992 | European Pat. Off. . | |

*Primary Examiner*—Brian K. Green
*Attorney, Agent, or Firm*—Brooks & Kushman

[57] ABSTRACT

A display with rearrangeable characters, for instance for price display at sales points, has a front plate with recesses for mounting rearrangeable digital, rod-shaped elements in the plate and displaying digital characters. A removable rear or locking plate is affixed to the plate. In their unlocked position, the elements are rotatable in the front plate about a transverse axis in each recess for the display of a desired digital character. Each element is self-locking in its resting position and secured so as to avoid further rotation in this position by the rear plate, thus together with adjacent elements showing the desired character as an unbroken whole.

4 Claims, 2 Drawing Sheets

DISPLAY WITH REARRANGEABLE CHARACTERS

This is a continuation of applications Ser. No. 08/007,517 filed on Jan. 22, 1993, now abandoned.

BACKGROUND OF THE INVENTION

The present invention relates to a display device with rearrangeable characters, such as a price display at sales points, or other displays, where a quick and simple change of the characters is desirable. A change of the display may be readily performed without the need for any loose signs, writing utensils or the like.

Such displays have become increasingly popular, especially as digital figures and letters are commonly used. The figures and letters are created on the basis of a number of basic elements which are activated individually and which together form the individual character.

The use of digital figures is commonly known from displays in, for example, CPUs, telephones and digital watches, where the individual figure section contains seven elements which may be activated electronically so as to form a combination showing a figure in the range of 0 to 9. A corresponding display of letters is also possible, but requires a slightly larger number of basic elements to be able to display any letter in the alphabet.

When using displays which are not electronically controlled, such as price displays at sales points, it may be advantageous to use digital displays which by means of elements built into or embedded in the display can create any desired character through manual activation of each individual element. of this type are known e.g. from U.S. Pat. No. 3,740,878, in which the individual character is created by means of a number of small squares in contrasting colors. The squares pivot on vertical shafts and form together a rectangular surface. The displaying of characters is effected by rotating squares of identical contrasting color into horizontal and vertical directions in the rectangle so as to form edged characters, preferably figures. The front plate of the display with the rectangles and the rotatable squares may after adjustment into the desired signs be locked to a rear plate so as to prevent further rotation of the squares. However, the display device according to U.S. Pat. No. 3,740,878 is not suitable for displaying digital characters, and it is not particular suitable for indoor price displaying, where the price displays should be relatively small and easy to read.

Another display, which is also primarily intended for outdoor use and therefore also of a relatively large and complex structure, is described in U.S. Pat. No. 4,411,084. The characters of this display are constituted by elements, which may be rotated on center axes and which after the rotation into the desired character may be locked in this position by means of special locking plates with recesses. The locking plates may be bolted to a rear plate. The rotation and the locking of the desired signs is thus complicated, and although in principle the display shows digital characters, these characters suffer from the obvious drawback that the individual elements do not abut against each other at their respective ends. As a result, this display is not suitable as a small-scale price display, e.g. for indoor use in retail shops.

In another known device, a sign containing a number of characters each consisting of seven basic elements is provided in which each segment has the shape of a flat stick. The individual elements at either end are tapering and secured to the substrate of the character by means of a pivot.

The front surface of the element in its resting position is substantially in plane with the substrate. One flat side of the element has the same color as the substrate, and the other flat side of the element is provided with a contrasting color. When an element is to be activated so as to form part of a figure, the rod is rotated manually about its longitudinal axis so that the side of the element with the contrasting color appears, and in this way each individual element is activated so as to form a combination of elements showing the desired figure. A deletion of the figure is effected by displaying the side of the element having the same color as the substrate.

A considerable drawback of the latter sign is that the tapering shape of the end of each element in connection with the pivotable securing of the rod to the substrate, do not allow a complete abutment of the elements at their oblique ends when displaying a figure. Consequently, an undesirable gap revealing part of the surface of the plate occurs, and therefore the character or number does not appear as an entity. Another drawback is that it is difficult to combine a self-locking device with the ball coupling between an element and a substrate at each rod end. Such self-locking device should prevent the individual element from being inadvertently rotated which would result in an error on the display.

SUMMARY OF THE INVENTION

It is the object of the present invention to provide a manually operated display with changeable digital characters and to eliminate the drawbacks mentioned above in connection with known display signs. The particular feature of the present invention is a display with easily changeable, self-locking, easily readable digital characters, which display is inexpensive and relatively small and therefore particularly suitable for indoor use, e.g. in retail shops.

The present invention includes a front plate having a plurality of recesses or openings corresponding to the number of elements needed to form the desired characters. For a sign displaying the numbers 0–9, seven elements are needed. A post or rod is provided in each recess. The rods have one or more flat portions around their peripheries in order to retain the elements at certain orientations relative to the front plate.

The elements are made from two members securely affixed together. The two members are secured together around one of the rods in one of the recesses and are adapted to rotate around the rods. The two members are locked together at their ends by mating post and socket members and by being fused if it is desired to permanently secure them together. A channel is provided in the center of each element for positioning of the rod. The two members are resilient and expand slightly to compensate for the rotation of the elements around the elliptically or non-round rod. The opposite sides of the elements have different colors, one color which matches the color of the front plate and another contrasting color.

A rear plate is preferably releasably attached to the rear of the front plate and is used to keep the elements from being rotated inadvertently.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

BEST MODE(S) FOR CARRYING OUT THE INVENTION

In FIGS. 1–6, a price display device comprising three 7-segment digital figures and a decimal point is disclosed.

Figure 1:
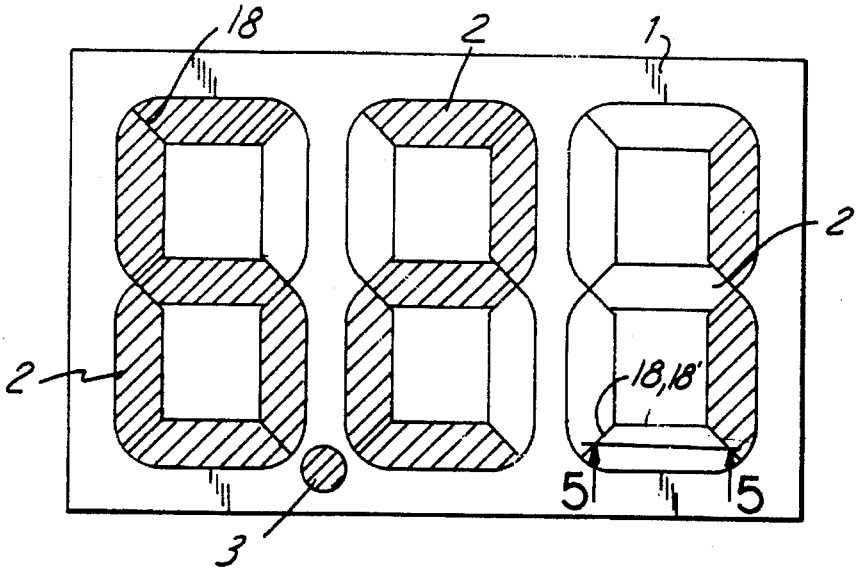
FIG. 1 is a front view of a display in accordance with the present invention.

In FIG. 1 the reference numeral 1 designates the front plate of the display. The front plate 1 is made of a material suitable for displays, e.g. nylon with glass. The reference numeral 2 designates an individual rotatable, changeable element and 3 designates a decimal point. The elements have on their first flat side the same color as the front plate, and on their second, flat side they have a contrasting color. In this manner, the individual element in its resting position in the front plate either forms an integrated part of or is clearly distinct from the front plate as far as color is concerned.

Figure 2:
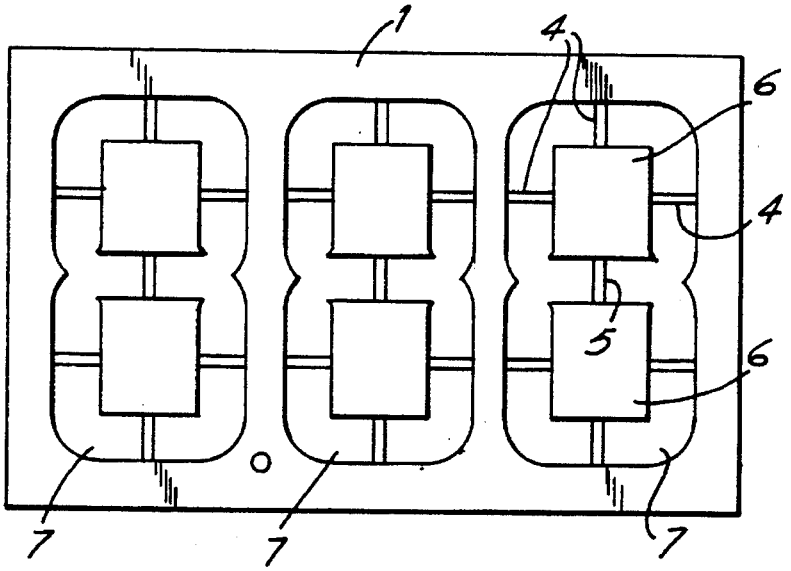
FIG. 2 depicts the front plate of the display, where the character elements have been removed.
Figure 5:
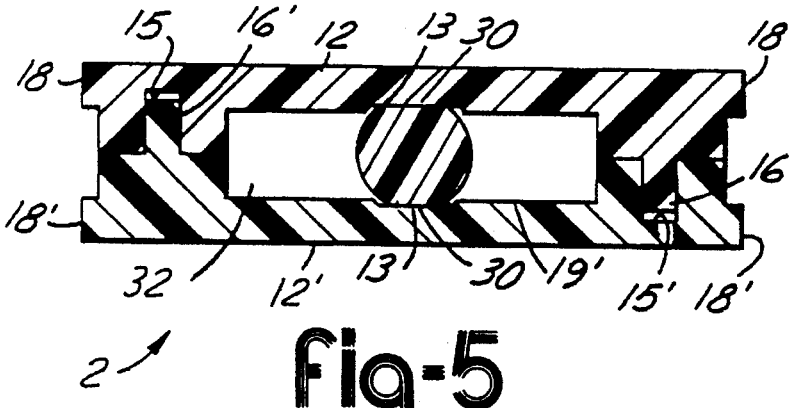
FIG. 5 is an enlarged, longitudinal and sectional view through a mounted element of FIG. 1 in its resting position in the front plate.
Figure 6:
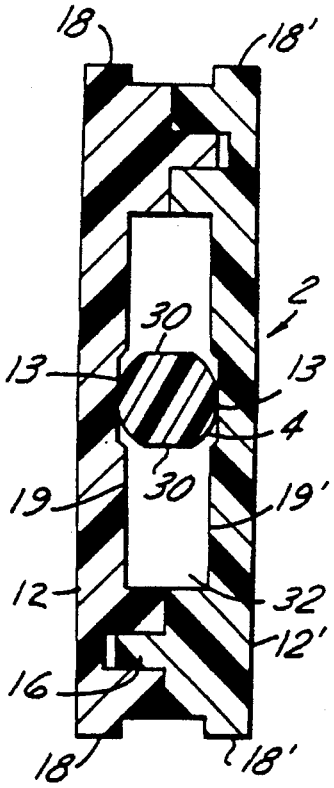
FIG. 6 is also an enlarged and longitudinal view through the mounted element of FIG. 1, which has been rotated into a position perpendicular to the front plate.

As shown in FIG. 2, the front plate 1 has a plurality of openings or recesses 7. Positioned within and adjacent the recesses are center areas 6 and rods 4 and 5. Rods 4,5 connect the center areas 6 with the remaining parts of the front plate 1, or with an adjacent center area. The shapes of the recesses 7 correspond to the elements 2 in their mounted position, which will appear from a comparison between FIGS. 1 and 2. The cross-sectional shape of the rods 4,5 is elliptical, as shown in FIGS. 5 and 6.

Figure 3A:
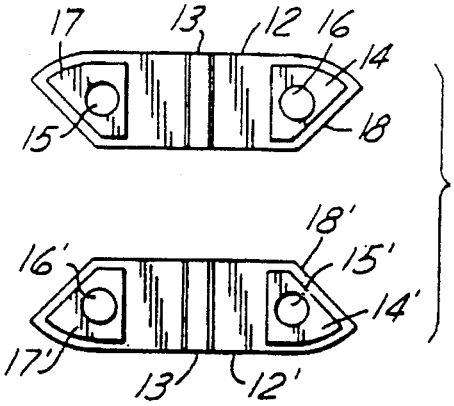
FIG. 3*a*–3*c* show a character element consisting of two complementary members.
Figure 3B:
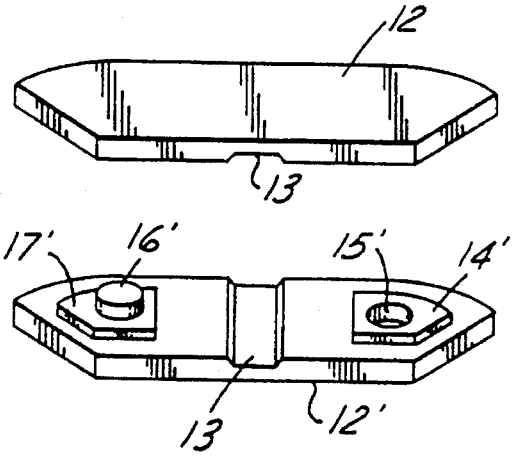
Figure 3C:
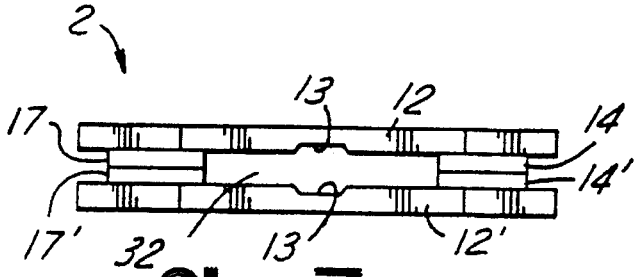

FIGS. 3*a*–3*c* show an individual element 2 consisting of two complementary members 12,12'. The members 12,12' preferably comprise a plastics material, e.g. impact-proof styrene or ABS. Each member has at one end a hole 15 for a projection 16' on the complementary member and correspondingly a projection 16 at the other end, which projection 16 fits into a hole 15' in the complementary member. Both members are provided with a transversal groove 13. The two members 12,12' are securely snapped or held together. When the element 2 is mounted in the plate 1, it essentially forms a bearing for the rod 4. Thus, the rod 4 becomes a transverse shaft, on which the element 2 may be rotated.

Furthermore, each element 2 has protrusions 14,14', 17,17' at its ends, which protrusions in pairs of two abut against each other when the element is mounted. The assembly of two members to each other into an element 2 in its assembled position around the transverse shaft 4 is preferably carried out by means of ultrasonic welding. Other mounting methods, such as an interference fit, may be employed depending on the size of the element. The end shapes 18,18' of the assembled element 2 are such that the end of an element without any gap abuts on the corresponding end of an adjacent element when the elements are embedded in the plate 1 so as to form the desired character. This is evident from FIG. 1.

Figure 4:
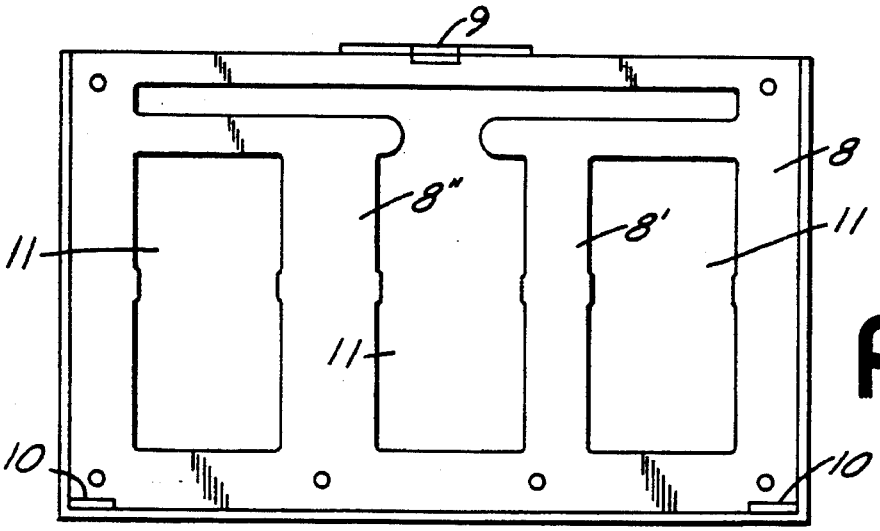
FIG. 4 shows the rear or locking plate of the display.

When the elements 2 are in the desired position showing the characters on the plate 1, any further rotation of the elements may be prevented by means of a rear or locking plate 8, as shown in FIG. 4. The plate 8 is preferably made of the same material as the plate 1. The rear or locking plate 8 is secured to the back of plate 1 by means of a flange 10 and a locking hook 9. In the locking plate 8, weight reducing recesses 11 are formed so that the remaining plate portions 8,8',8" prevent inadvertent rotation of the elements 2 when the rear plate 8 is arranged on the front plate 1.

As shown in FIGS. 5 and 6, the individual element 2 is self-locking in the embedded position (resting position) in the plate 1 with the element assembled around shaft 4. The self-locking has been obtained in the following manner: the shaft 4, which is cast or punched integrally with the plate 1, has a circular cross-section and is trimmed or formed in such a way that the shaft 4 has flat sides 30 forming surfaces, which are parallel with the front and rear sides of the plate 1. The cross-section of the shaft 4 thereby becomes almost elliptical, and the great axis is parallel to the plane of the plate 1, while the small axis is perpendicular to the plate. Each element 2 has an inner recess 32, surfaces 19,19' of which in the assembled (welded) element 2 in its embedded position in the plate 1 abut firmly against the surfaces 30 of the shaft 4.

To further ensure the abutment against the flat surfaces 30 of the shaft 4, the recess surfaces 19,19' are typically provided with grooves 13 in the transversal direction of the element. If the element 2 is rotated manually out of its embedded position into a position perpendicular to the plate 1, as shown in FIG. 6, the surfaces 19,19' will slide along and onto the curved surfaces of the shaft 4, and at the same time the gap formed by the recess 32 between the members 12, 12' is slightly expanded, which the resiliency of the material allows, and a spring tension exerted on the shaft 4 is generated in the two members 12,12'. If the rotation of the element 2 is continued until it reaches its embedded position in the plate again, the spring tension will urge the surfaces 19,19' in the members into firm abutment with the flat surfaces 20 of the shaft 4 with a small "click".

As will readily appear from FIGS. 5 and 6, the manual rotation of an element into the desired character on the plate 1 may take place in both directions about the shaft 4. Depending on the number of elements 2 which have their contrasting color positioned face up in FIG. 1, the seven elements form one of numbers 0–9. (In FIG. 1, the letters have been rotated to present the amount 6.21.)

What is claimed:

1. A display device with rearrangeable characters adapted for displaying digital figures and letters, said display device comprising:

a substantially planar front plate member with a plurality of openings and a corresponding plurality of pivotable character elements rotatable positioned in said openings, each of said character elements having a first and a second display surface with different colors and being adapted to be rotatable by manual manipulation between a first display position wherein the element is clearly distinct from the front plate member by the color of said first display surface and a second display position wherein the element is integrated into the front plate member by the color of said second display surface, a rear plate member releasably secured onto the front plate member and positioned immediately adjacent said character elements to physically lock said character elements in their selected display positions, said openings in said front plate member being arranged on said front plate member to form a plurality of center portions, each of said center portions being connected to a remaining part of the front plate member or to an adjacent center portion by shaft members extending completely across said openings and serving as pivots for said character elements, each of said character elements having a pair of complementary members which are assembled by means of projections in one complementary member and corresponding holes in the other complementary member so as to form between opposing inner surfaces of the complementary members of the pair a cavity adapted to receive said shaft members on said front plate member, said character elements being formed at their respective ends wherein they substantially abut against each other, thereby providing an integral displaying of a digital-type figure or letter on said display device, each of said shaft members in said openings having forwardly and rearwardly facing flat portions in relation to the plane of the display device, said shaft members having plane side portions parallel with the plane of the front plate member, and each of said character elements being made of a resilient material capable of providing a spring tension and each of said character elements having front and rear surfaces which are planar aligned with the plane side portions of the shaft members when the character elements are in either of their display positions, and to abut on other portions of the shaft when the character elements are in any other position, whereby the resilient material of said character elements can be deformed against the action of the spring tension.

2. A display device according to claim 1 wherein said shaft members have a substantially elliptical cross-section, where the great axis of the ellipse is parallel to the plane of the front plate member and where the small axis of the ellipse is perpendicular to the plane of the front plate member.

3. A display device according to claim 1 wherein the cavity in each character element has such a height that the opposing inner surfaces of said cavity in its resting position abut firmly against the plane side portions of the shaft members and that the material of said character members has a resiliency which the character elements, when rotated into positions perpendicular to the front plate member, increase the height of the cavity against spring tension in the material so that the inner surfaces slide upward onto curved parts of said shaft members.

4. A display device according to claim 3 wherein each complementary member of each of said character elements has a transversal groove on the opposing inner surfaces of the cavity, said groove being a bearing for said shaft member when said character element is mounted around the shaft member in the front plate member.

* * * * *

UNITED STATES PATENT AND TRADEMARK OFFICE

CERTIFICATE OF CORRECTION

PATENT NO. : 5,577,336

DATED : Nov. 26, 1996

INVENTOR(S) : Jensen

It is certified that error appears in the above-identified patent and that said Letters Patent is hereby corrected as shown below:

Column 1, line 33, before "of" insert -- Displays --;

Column 1, line 46, delete "particular" and insert -- particularly --;

Column 4, line 46, before "6.21" insert -- $ --;

Signed and Sealed this

Eighteenth Day of November 1997

*Attest:*

*Attesting Officer*

Bruce Lehman

BRUCE LEHMAN

*Commissioner of Patents and Trademarks*